US005310636A

United States Patent [19]

Ohmatsu et al.

[11] Patent Number: 5,310,636

[45] Date of Patent: May 10, 1994

[54] SILVER HALIDE PHOTOGRAPHIC MATERIAL AND THE DEVELOPMENT PROCESSING METHOD

[75] Inventors: Hideki Ohmatsu; Rikio Inoue, both of Kanagawa, Japan

[73] Assignee: Fuji Photo Film Co., Ltd., Kanagawa, Japan

[21] Appl. No.: 783,173

[22] Filed: Oct. 28, 1991

[30] Foreign Application Priority Data

Oct. 31, 1990 [JP] Japan ..... 2-295051
May 13, 1991 [JP] Japan ..... 3-135227

[51] Int. Cl.[5] ..... G03C 1/46

[52] U.S. Cl. ..... 430/502; 430/503; 430/509; 430/963; 430/966

[58] Field of Search ..... 430/502, 503, 509, 963, 430/966

[56] References Cited

U.S. PATENT DOCUMENTS 4,177,071 12/1979 De Brabandere et al. ..... 430/966
4,511,648 4/1985 Yamashita et al. ..... 430/503
4,520,098 5/1985 Dickerson ..... 430/567
4,908,300 3/1990 Koboshi et al. ..... 430/503
5,176,987 1/1993 Nakamura et al. ..... 430/963

FOREIGN PATENT DOCUMENTS 0123832 6/1986 Japan ..... 430/502
0110549 5/1991 Japan ..... 430/503
0110552 5/1991 Japan ..... 430/502

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material having less roller marks and a rapid drying speed while maintaining a high sensitivity, and a development processing method therefor is disclosed. The silver halide photographic material comprising a support having, on at least one side thereof, two or more light-sensitive silver halide emulsion layers comprising a binder and a silver halide emulsion having a silver iodide content of 1 mol % or less, wherein the silver iodide content of the emulsion layer closest to the support is less than the silver iodide content of any of the emulsion layers further from the support than the emulsion layer closest to the support.

14 Claims, No Drawings

SILVER HALIDE PHOTOGRAPHIC MATERIAL AND THE DEVELOPMENT PROCESSING METHOD

FIELD OF THE INVENTION

The present invention relates to a silver halide photographic material and a development processing method thereof, more specifically, the present invention relates to a technique which provides excellent rapid processing property, that is, which can provide a higher sensitivity and a shorter drying time in a short time development processing, and in which roller marks generated in the processing of a photographic film can be decreased. Even more specifically, the present invention relates to an X-ray film for an extra rapid processing.

BACKGROUND OF THE INVENTION

Recently, use of a high temperature rapid processing in the developing step of a photographic material has rapidly increased and the processing time has been shortened to a large extent as well in the processing of the various light-sensitive materials with an automatic processor. In order to achieve a high temperature rapid processing, a developing solution capable of providing a sufficiently high sensitivity in a short time development, a light-sensitive material having an excellent developability with no stain by a residual color even in a shorter time processing, and a light-sensitive material which can be dried in a short time after washing with water are all required. Most automatic processors have built-in drying units and therefore, a higher drying capability is required for the automatic processor if the light-sensitive materials used have inferior drying properties. This, in turn, means that the size of the automatic processor must be expanded. Further, the generation of a lot of heat results in disadvantages such as raising the temperature of the room in which the automatic processor is installed.

In order to prevent these disadvantages, an effort is made to expedite the drying speed of a light-sensitive material as much as possible. The usually used method is to decrease the water content of the light-sensitive material before starting drying by lowering the swelling rates of an emulsion layer and a surface protective layer thereof in the developing, fixing and washing steps, wherein a sufficient amount of a hardener is added in advance to the light-sensitive material during a coating step. In this method, a large quantity of hardener used can increase the drying speed but on the other hand problems such a delayed development and a lowered sensitivity due to the increased hardening, a deteriorated covering power and a delayed fixing speed of the undeveloped silver halide grains even with tabular grains having a high aspect ratio, a deteriorated color residue, and increased amount of hypo remaining in the light-sensitive material after processing occur. The water content in a light-sensitive material before starting drying can also be decreased by reducing the amount of a hydrophilic substance present in the light-sensitive material, i.e., gelatin, synthetic polymer and a hydrophilic low molecular weight substance. In general, a hydrophilic low molecular weight substance is used to prevent drying fog of a silver halide grain in a coating step and the removal thereof causes fog of the light-sensitive material to occur. Meanwhile, the removal in gelatin and/or the synthetic polymer used as a binder for the silver halide grains results in a decrease in the ratio of a binder to silver halide grains, and this, in turn, results in an increase in the ratio Ag/binder. A decrease in an amount of the binder causes disadvantages such as a deteriorated graininess and a tendency for the generation of roller marks in processing. The term "roller marks" as used herein means spot-like silver images formed by pressure of carrier roller in an automatic processor. The generation of roller marks is an obstacle to examine the film for a medical use and is undesirable. These disadvantages make it difficult to decrease the amount of the binder even if a decrease in the amount of the binder is attempted to improve drying properties.

SUMMARY OF THE INVENTION

An object of the present invention is to solve the above-described problems in conventional technologies and to provide a photographic material having less roller marks in processing and a high sensitivity even when subjected to short time processing yet having a sufficiently fast drying speed, and a development processing method therefor.

The above object of the present invention has been achieved by a silver halide photographic material comprising a support having, on at least one side thereof, two or more light-sensitive silver halide emulsion layers comprising a binder and a silver halide emulsion having a silver iodide content of 1 mol % or less, wherein the silver iodide content of the emulsion layer closest to the support is less than the silver iodide content of any of the emulsion layers farther from the support than the layer closest to the support.

DETAILED DESCRIPTION OF THE INVENTION

The present invention is explained in greater detail below.

Silver iodochloride and silver iodobromide emulsion can be used in the photographic material of the present invention. A silver iodobromide emulsion is preferred from the standpoint of higher sensitivity.

An emulsion having a silver iodide content of zero, that is, an emulsion of pure silver chloride or pure silver bromide is included in the scope of the present invention and such an emulsion can be used for the layer closest to a support of the photographic material of the present invention.

In the present invention, the silver iodide content of the emulsion layer closest to the support is preferably 0.1 mol % or less, more preferably 0.05 mol % or less, and most preferably 0 mol %, and on the other hand, the silver iodide content of the other emulsion layer or layers is preferably 0.1 to 1 mol %, and more preferably 0.2 to 0.8 mol %.

In general, a tabular silver iodobromide emulsion is widely used because it has less fog than a tabular pure silver bromide emulsion but even so it has a disadvantage that it tends to cause roller marks. This is considered to be attributable to a infectious development effect due to iodide ion. However, the detailed mechanism thereof has not yet been clarified.

Therefore, the preferable layer structure of the silver halide photographic material of the present invention is that the silver halide emulsion layer closer to the support comprises an emulsion of pure silver bromide and the silver halide emulsion layer or layers farther from the support than the above layer comprises a silver iodobromide emulsion. In this case, the pure silver bromide/silver iodobromide molar ratio of the photographic material is preferably 2/1 to ½.

The reason why the generation of roller marks can be prevented by the layer structure of the present invention is not clear. It may be due to the fact that the roller marks tend to be generated in the emulsion layers closer to the support.

The halogen composition in the silver halide grains can be determined, for example, by the powder X ray diffraction method described in JP-A-56-110926 (the term "JP-A" as used herein means an unexamined published Japanese patent application).

It is necessary in the layer structure of the photographic material of the present invention to provide two or more emulsion layers on one side of a support and the weight ratios of the silver halide to the hydrophilic binder (the silver/binder ratio) of the respective layers may be the same or they may be different from each other. In particular, a preferable layer structure is for the silver/binder weight ratio of the emulsion layer closest to the support is set at a higher level. The silver/binder weight ratio of the emulsion layers is preferably 0.6 or more (particularly 0.8 or more) and 2.5 or less. In particular, the emulsion layer closest to the support preferably has a silver/binder weight ratio of 0.8 or more and 2.5 or less.

The coated silver amounts of the respective emulsion layers may be the same or different. The total amount of coated silver on the both sides of the support is preferably 2.5 $g/m^2$ to 5 $g/m^2$.

The silver halide emulsion may be a monodispersed core/shell type emulsion, for example, as described in JP-A-54-48521.

Where a polydispersed silver halide emulsion is used in the present invention, it can be prepared by conventional methods, for example, a neutral method, an acidic method, an ammonia method, a regular mixing method, a reverse mixing method, a double-jet method, a controlled double-jet method, a conversion method, and a core/shell method, each of which is described in T. H. James, *The Theory of the Photographic Process*, 4th Edition (1977), pp. 38 to 104, published by Macmillan Co.

The iodide present in a silver iodochloride or silver iodobromide emulsion used in the present invention may be supplied in such a manner that an iodide ion is added in advance to a halide solution used for forming the silver halide grains or it may be supplied on the surface of the grains from a KI aqueous solution or fine silver iodide grains after the completion of grain formation. In supplying iodide on the surface of the emulsion grains, it is particularly preferred to use a silver halide solvent and above all, KSCN is preferably used as such a silver halide solvent.

The silver halide emulsion used in the present invention preferably comprises tabular silver halide grains (hereinafter referred to as tabular silver halide emulsion). Details of the tabular silver halide grains are set forth in *Research Disclosure*, vol. 225, Item 22534, pp. 20 to 58, January 1983, and in JP-A-58-127921 and JP-A-58-113926.

Method known in the art can be suitably combined to prepare tabular silver halide emulsions, if desired.

The tabular silver halide emulsions are described in "Evolution of the Morphology of Silver Bromide Crystals During Physical Ripening", *Science & Industrie Photographie*, Cugnac and Chateau, Vol. 33, (1962), pp. 121 to 125, Duffin, *Photographic Emulsion Chemistry*, published by the Focal Press Co., New York, 1966, pp. 66 to 72, and *Photographic Journal*, Vol, 80, p. 285 (1940), A. P. H. Trivelli and W. F. Smith. They can be readily prepared with reference to the methods described in JP-A-58-127921, JP-A-58-113927 and JP-A-58-113928, and U.S. Pat. No. 4,439,520.

Further, tabular silver halide emulsions can be prepared by forming seed grains containing tabular grains of 40% by weight or more in an atmosphere of a relatively low pBr value of 1.3 or lower and growing seed grains by adding simultaneously a silver salt solution and a halide solution while maintaining the pBr value at the above value. In this grains growth step, the silver salt and halide solutions are preferably added so that new crystal nuclei are not formed.

The sizes of the tabular silver halide grains can be controlled by regulating the temperature, the kind and an amount of silver halide solvent selected, and controlling the addition rates of the silver salt solution and the halide solution used in growing the grains.

Monodispersed hexagonal tabular silver halide rain are particularly useful of the tabular silver halide grains.

The details of the structure and the preparing method of the monodispersed hexagonal tabular grains suitable for the present invention are described in JP-A-63-151618. Briefly, the above emulsion comprises a dispersant and silver halide grains, in which hexagonal grains which have a ratio of the longest side to the shortest side of 2 or less and two parallel outermost planes comprise 70% or more of the whole projected area of the grains; and further, the grains are monodispersed where the coefficient of variation in the grain size distribution of the hexagonal tabular silver halide grains is 20% or less, wherein the coefficient of variation is defined by the value obtained by dividing the standard deviation of the grain sizes expressed by the diameters of circles corresponding to the projected area of the grains with the average grain size.

The crystal structure of the grains may be uniform, preferably of different compositions in the inside and outer layers. The grains may have a stratum structure. Further, the grains preferably contain therein a reduction-sensitized silver nucleus.

In the present invention, the so-called halogenconversion type grains described in British Patent 635,841 and U.S. Pat. No. 3,622,318 can be particularly effectively used. The surface of the tabular silver halide grains used in the present invention can be subjected to a conversion treatment to obtain an emulsion having a higher sensitivity.

Halogen conversion is usually carried out by adding a solution of a halide of which the silver salt has a smaller solubility product than those of silver halide present on the surfaces of the grains before they are subjected to the halogen conversion. For example, a potassium iodide solution is added to the silver bromide or silver iodobromide tabular grains to subject the grains to the halogen conversion. The lower the concentration of these solutions added, the more preferable. It is preferably 30% or less, more preferably 10% or less. The halide solution for the halogen conversion is added preferably at a rate of 1 mol % or less per minute per mol of silver halide present before carrying out the halogen conversion. Further, a sensitizing dye may be present during the halogen conversion and fine grains of silver iodobromide and silver iodide may be added in place of the halide solutions for the halogen conversion. The size of these fine grains is 0.2 μm or less, preferably 0.1 μm or less and particularly 0.05 μm or less. The amount of halogen conversion is preferably 0.1 to 1 mol %, particularly 0.1 to 0.6 mol %, of silver halide present before carrying out the halogen conversion.

The halogen conversion method used in the present invention is not limited to any one of the above methods and a combination of these methods can be used according to the purpose. The composition of the surface of the grains before carrying out the halogen conversion is preferably an iodide content of 1 mol % or less, particularly 0.3 mol % or less.

It is particularly effective for a silver halide solvent to be present in carrying out halogen conversion by the above methods. Preferable solvents and thioether compounds, thiocyanates, and 4-substituted thioureas. Of them, a thioether compound and a thiocyanate are particularly effective. The thioether compound and thiocyanate are needed preferably in amounts of 0.2 to 3 g per mol of silver halide and 0.5 to 5 g per mol of silver halide, respectively.

Silver halide grains having an aspect ratio of 2 or more are preferably present in the tabular silver halide emulsions of the present invention in a ratio of 50% or more of the whole grains (projected area), particularly 70% or more of the whole grains.

Tabular silver halide grains which can be used in the present invention have a projected areacorresponding diameter of preferably 0.3 to 2.0 μm, particularly 0.5 to 1.2 μm. Further, the distance (i.e., the thickness) between the parallel planes is preferably 0.05 to 0.3 μm, particularly 0.1 to 0.25 μm. The aspect ratio thereof is preferably 3 or more and less than 20, particularly 4 or more and 8 or less.

In order to efficiently achieve the effects of the present invention, a silver halide-adsorbing substance of $5\times10^{-4}$ mol or more per mol of silver halide is preferably present in a chemical ripening step during the emulsion preparation as described in JP-A-2-68539. This silver halide-adsorbing substance may be added at any time during the formation of the grains, such as immediately after the formation of the grains, and before or after the initiation of a post-ripening. It is added preferably before adding a chemical sensitizer (for example, gold and sulfur sensitizers) or at the same time as the addition of a chemical sensitizer. It should be present during at least the step of carrying out the chemical ripening.

The silver halide-adsorbing substance may be added at any temperature within the range of 30° to 80° C. It is preferably added within the range of 50° to 80° C. for the purpose of strengthening the adsorbability. The pH and pAg may also be varied but are preferably 5 to 10 and 7 to 9, respectively, when chemical sensitization is carried out.

The silver halide-adsorbing substance used in the present invention means a sensitizing dye and a photographic property stabilizer.

Examples include many compounds known as an antifoggant or a stabilizer and includes azoles such as a benzothiazolium salt, a benzoimidazolium salt, imidazoles, benzoimidazoles, nitroindazoles, triazoles, benzotriazoles, tetrazoles, and triazines; mercapto compounds such as mercaptothiazoles, mercaptobenzothiazoles, mercaptoimidazoles, mercaptobenzimidazoles, mercaptobenzoxazoles, mercaptothiadiazoles, mercaptoxadiazoles, mercaptotetrazoles, mercaptotriazoles, mercaptopyrimidines, and mercaptotriazines; thioketo compounds such as oxadolinethions; azaindenes such as triazaindenes, tetrazaindenes [in particular, 4-hydroxy-substituted (1,3,3a,7)tetrazaindenes], and pentazaindenes.

Further, purines, nucleic acids or polymers described in JP-B-61-36213 (the term "JP-B" as used herein means an examined Japanese patent publication) and JP-A-59-90844 can be utilized as the adsorbing substance. Among them, azaindenes, purines and nucleic acids are particularly preferably used in the present invention. The amount of these compounds employed is 10 to 300 mg per mol of silver halide, preferably 20 to 200 mg per mol of silver halide.

A sensitizing dye can provide the preferable effects of the present invention as the silver halide adsorbing substance used in the present invention.

Suitable sensitizing dyes include a cyanine dye, a merocyanine dye, a complex cyanine dye, a complex merocyanine dye, a holopolar cyanine dye, a styryl dye, a hemicyanine dye, an oxonol dye, and a hemioxonol dye.

Usable specific sensitizing dyes which can be used in the present invention are described in, for example, U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, and 2,503,776, JP-A-48-76525, and Belgian Patent 691,807. The amount of the sensitizing dye used is 300 mg or more and less than 2000 mg per mol of silver halide, preferably 400 mg or more and less than 1000 mg per mol of silver halide.

Specific examples of useful sensitizing dyes for the present invention are shown below:

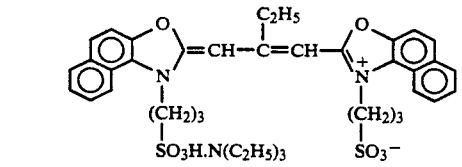

I-1

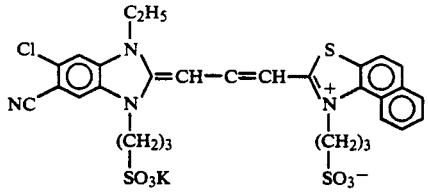

I-2

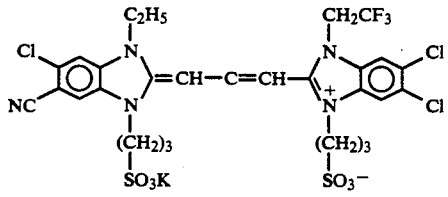

I-3

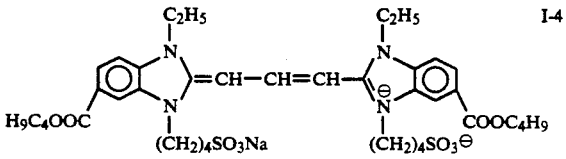

I-4

-continued

I-5

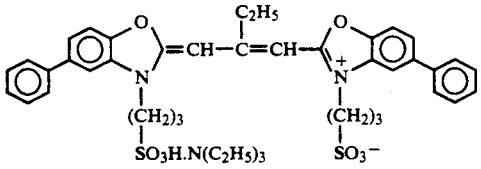

I-6

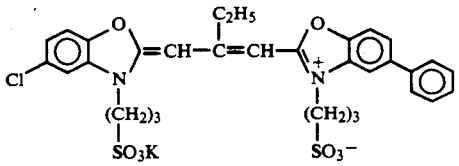

I-7

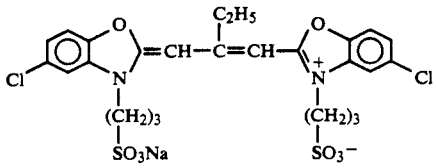

I-8

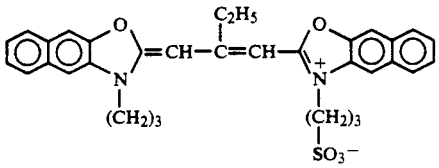

The combined use of the sensitizing dye and a stabilizer as described previously is a preferable embodiment of the present invention.

The sensitizing dye used in the present invention may be added between chemical sensitization and coating.

The chemical sensitization of the silver halide emulsion used in the present invention can be carried out in the presence of the silver halide-adsorbing substance using known methods, such as a sulfur sensitizing method, a selenium sensitizing method, a reduction sensitizing method, and a gold sensitizing method. These methods can be employed alone or in combination thereof.

A gold sensitizing method is a typical noble metal sensitizing method and gold compounds, mainly the gold complex salts, are used. Complex salts of the noble metals other than gold, for example, platinum, palladium and iridium may also be used. Examples thereof are described in U.S. Pat. No. 2,448,060 and British Patent 618,061.

The sulfur compounds contained in gelatin and in addition, various sulfur compounds such as thiosulfates, thioureas, thioazoles and rhodanines can be used as sulfur sensitizers.

The examples of sulfur sensitizers are the compounds described in U.S. Pat. Nos. 1,574,944, 2,278,947, 2,410,689, 2,728,668, 3,501,313, and 3,656,955.

The use of sulfur sensitization with a thiosulfate and gold sensitization in combination can efficiently demonstrate the effects of the present invention.

A stannous salt, amines, formamidine sulfinic acid, and a silane compound can be used as reduction sensitizers.

The photographic emulsions used in the present invention can contain separately from the silver halide-adsorbing substance used at a chemical sensitization in the present invention, various compounds for the purposes of preventing fog and stabilizing the photographic properties during preparation, storage and photographic processing of the photographic light-sensitive materials. Many compounds which are known as antifoggants and stabilizers can be used and these include azoles such as benzothiazolium salts, nitroimidazoles, nitrobenzimidazoles, chlorobenzimidazoles, bromobenzimidazoles, nitroindazoles, benzotriazoles, and aminotriazoles; mercapto compounds such as mercaptothiazoles, mercaptobenzothiazoles, mercaptobenzimidazoles, mercaptothiadiazoles, mercaptotetrazoles, mercaptopyrimidines, and mercaptotriazines; thioketo compounds such as oxadolinethions; azaindenes such as triazaindenes, tetrazaindenes [in particular, 4-hydroxy-substituted (1,3,3a,7)tetrazaindenes], and pentazaindenes; and benzene thiosulfonic acid, benzenesulfinic acid, and benzene sulfonic acid amide.

Of them, particularly preferred are nitrons and the derivatives thereof described in JP-A-60-76743 and JP-A-60-87322; mercapto compounds described in JP-A-60-80839; heterocyclic compounds described in JP-A-57-164735; and the complex salts of heterocyclic compounds and silver (e.g., silver 1-phenyl-5-mercaptotetrazole).

When a sensitizing dye is used as the silver halide-adsorbing substance at the chemical sensitization, sensitizing dyes having spectral sensitivity in different wavelength region may be added, if necessary.

The photographic emulsion layers and other hydrophilic colloid layers of the photographic materials prepared according to the present invention may contain various surfactants for various purposes such as a coating aid, prevention of static charge generation, improvement in a sliding property, emulsification-dispersion, prevention of sticking, and improvement in the photographic characteristics (e.g., acceleration of development, hardening and sensitization).

Nonionic surfactants such as saponin (steroid type), alkylene oxide derivatives (e.g., polyethylene glycol, a polyethylene glycol/polypropylene glycol condensation product, polyethylene glycol alkyl ethers, polyethylene glycol alkyl aryl ethers, and adducts of silicone and polyethylene oxide), and alkyl esters of sucrose; anionic surfactants such as alkylsulfonic acid salts, alkylbenzenesulfonic acid salts, alkylnaphthalenesulfonic acid salts, alkyl sulfates, N-acyl-N-alkyltaurines, sulfosuccinates, and sulfoalkyl polyoxyethylenealkyl phenyl ethers; amphoteric surfactants such as alkylbetains and alkylsulfobetains; and cationic surfactants such as aliphatic or aromatic quaternary ammonium salts, pyridinium salts, and imidazolium salts, can be used.

Of them, particularly preferred are anionic surfactants such as saponin, sodium dodecylbenzenesulfonate, sodium di-2-ethylhexyl-a-sulfosuccinate, sodium p-octylphenoxyethoxyethanesulfonate, sodium dodecylsulfate, sodium triisopropylnaphthalenesulfonate, and sodium N-methyl-oleoyltaurine; cationic surfactants such as dodecyltrimethylammonium chloride, N-oleoyl-N' ,N',N'-trimethylammoniodiaminopropane bromide, and dodecylpyridium chloride; amphoteric surfactants such as betaines including N-dodecyl-N,N-dimethylcarboxybetaine and N-oleyl-N,N-dimethylsulfobutylbetaine; and nonionic surfactants such as polyoxyethylene cetyl ether (average polymerization degree n=10), polyoxyethylene-p-nonyl-phenol ether (n=25), and bis(1-polyoxyethyleneoxy-2,4-di-t-pentylphenyl)ethane (n=15).

Suitable anti-static charge agents include fluorinated surfactants such as potassium perfluorooctanesulfonate, sodium N-propyl-N-perfluorooctanesulfonyl glycine, sodium N-propyl-N-perfluorooctanesulfonylaminoethyloxy polyoxyethylenebutanesulfonate (n=3), N-perfluorooctanesulfonyl-N',N',N'-trimethylammoniodiaminopropane chloride, and N-perfluorodecanoylaminopropyl-N',N'-dimethyl-N'-carboxy betaine; nonionic surfactants described in JP-A-60-80848, JP-A-61-112144, JP-A-62-172343 and JP-A-62-173459; alkali metal nitrate; electroconductive tin oxide; zinc oxide; vanadium hexaoxide; and composite oxides in which antimony is doped into the above metal oxides.

In the present invention, a matting agent, organic compounds such as a homopolymer of methyl methacrylate, a copolymer of methyl methacrylate and methacrylic acid, and starch, and the fine particles of inorganic compounds such as silica, titanium dioxide, strontium sulfate and barium sulfate, as described in U.S. Pat. Nos. 2,992,101, 2,701,245, 4,142,894, and 4,396,706 can be used.

The particle size thereof is preferably 1.0 to 10 μm, particularly 2 to 5 μm.

The silicone compounds described in U.S. Pat. Nos. 3,489,576 and 4,047,958, and colloidal silica described in JP-B-56-23139 as well as paraffin wax, higher fatty acid ester and a starch derivative can be used as a lubricant for the surface layer of the photographic material of the present invention.

Polyols such as trimethylol propane, pentanediol, butanediol, ethylene glycol, and glycerine can be used as a plasticizer for the hydrophilic colloid layers of the photographic material of the present invention.

Gelatin is used advantageously as a binder or protective colloid in an emulsion layer, an intermediate layer and a surface protective layer of the photographic material of the present invention. Hydrophilic colloids other than gelatin can be used as well. Examples thereof are proteins such as a gelatin derivative, a graft polymer of gelatin and other polymers, albumin and casein; cellulose derivatives such as hydroxyethylcellulose, carboxymethylcellulose and cellulose sulfuric acid esters; sucrose derivatives such as sodium alginate, dextran and a starch derivative; and various synthetic hydrophilic polymers such as homopolymers and copolymers of vinyl alcohol, partially-acetalized vinyl alcohol, N-vinylpyrrolidone, acrylic acid, methacrylic acid, acrylamide, vinylimidazole, and vinylpyrazole.

Acid-treated gelatin and enzyme-treated gelatin as well as lime-treated gelatin, and the hydrolysis product and enzyme-decomposition products of gelatin can be used as well.

Among them, dextran having an average molecular weight of 50,000 or less and polyacrylamide can be used preferably in combination with gelatin. The methods described in JP-A-63-68837 and JP-A-63-149641 are effective also in the present invention.

The photographic emulsions and light-insensitive hydrophilic colloids used in the present invention may contain an inorganic or organic hardener. Preferred examples thereof are chromium salts (e.g., chrome alum and chromium acetate), aldehydes (e.g., formaldehyde, glyoxal and glutaric aldehyde), N-methylol compounds (e.g., dimethylol urea and methylol dimethylhydantoin), dioxane derivatives (e.g., 2,3-dihydroxydioxane), active vinyl compounds (e.g., 1,3,5 triacryloyl-hexahydro-s-triazine, bis(vinylsulfonyl)methyl ether, and N,N'-methylenebis-[β-(vinylsulfonyl)propionamide]), active halogen compounds (e.g., 2,4-dichloro-6-hydroxy-s-triazine), mucohalogen acids (e.g., mucochloric acid and mucophenoxychloric acid), isoxazoles, dialdehyde starch, and 2-chloro-6-hydroxytriazinylized gelatin. They can be used alone or as a combination thereof. Of them, the active vinyl compounds described in JP-A-53-41221, JP-A-53-57257, JP-A-59-162546 and JP-A-60-80846, and the active halogen compounds described in U.S. Pat. No. 3,325,287 are preferred.

A polymer hardener can also be used as the hardener in the present invention. Examples of suitable polymer hardeners which can be used in the present invention are a polymer having an aldehyde group such as dialdehyde starch, polyacrolein, and an acrolein copolymer described in U.S. Pat. No. 3,396,029; a polymer having an epoxy group described in U.S. Pat. No. 3,623,878; a polymer having a dichlorotriazine group described in U.S. Pat. No. 3,362,827 and *Research Disclosure* 17333 (1978); a copolymer having an active ester group described in JP-A-56-66841; and a polymer having an active vinyl group or a precursor group therefore described in JP-A-56-142524 and JP-A-54-65033, U.S. Pat. No. 4,161,407 and *Research Disclosure* 16725 (1978). Among them, a polymer having an active vinyl group or a precursor group therefor are preferred. A polymer in which an active vinyl group or a precursor group therefor is bonded to a main polymer chain via long spacer, as described in JP-A-56-142524, is particularly preferred.

The hydrophilic colloid layers of the photographic material of the present invention are preferably hardened with these hardeners so that the swelling rate of the photographic material in water becomes 280% or lower, particularly 200 to 280%.

The swelling rate in water in the present invention is measured by a freeze drying method, in which a photographic material is left standing under the conditions of 25° C. and 60% RH for 7 days and then, the swelling rate of the hydrophilic colloid layer is measured in the following manner; the dry thickness (a) of a cut piece is measured with a scanning electron microscope; after the photographic material is dipped in distilled water at 21° C. for 3 minutes, it is subjected to freeze drying with liquid nitrogen; then, it is observed with a scanning electron microscope to obtain a swelling layer thickness (b); and the swelling rate is calculated using the following equation:

$$\text{Swelling rate } (\%) = [(b)-(a)]/(a) \times 100$$

In the present invention, the photographic emulsion layers and other layers may be colored with a dye for the purposes of preventing halation and irradiation and providing a filter layer to control a spectral composition of a light incident to the photographic emulsion layers. In a film coated on both sides, such as an X-ray film for a medical use, a crossover-cutting layer may be provided under an emulsion layer. The dyes used for the above purposes are an oxonol dye having a pyrazolone nucleus and a barbituric acid nucleus, an azo dye, an azomethine dye, an anthraquinone dye, an arylidene dye, a styryl dye, a triarylmethane dye, a merocyanine dye, and a cyanine dye.

These dyes can be mordanted using an anionic dye to the specific layer in the photographic material with a polymer having a cationic site. It is preferable to use dyes which can be irreversibly decolored during the steps of developing, fixing and washing. The layer to which the dye is mordanted with the polymer having a cationic site may be any of an emulsion layer, a surface protective layer and a layer opposite the emulsion layer via a support. It is preferably a layer present between the emulsion layer and the support. For the purpose of cutting a crossover in an X ray film coated on both sides, the dye is mordanted preferably in a subbing layer.

The solid dispersion method described in JP-A-55-155350, International Publication WO88/04794 and Japanese Patent Application No. 2-118042 are also effective as a method of fixing a dye.

A polyethylene type nonionic surfactant is used preferably in combination with a polymer having a cationic site as a coating aid for the subbing layer.

A cationic site-providing polymer is preferably an anion-modified polymer.

Examples of anion-modified polymer include various known quaternary ammonium or phosphonium salt polymers. The quaternary ammonium or phosphonium salt polymers are widely known as a mordant polymer and an anti-static charge polymer and are described in the following publications:

latexes dispersed in water, described in JP-A-59-166940, JP-A-55-142339, JP-A-54-126027, JP-A-54-155835, JP-A-53-30328, and JP-A-54-92274 and U.S. Pat. No. 3,958,995; polyvinylpyridinium salts described in U.S. Pat. Nos. 2,548,564, 3,148,061, and 3,756,814; water-soluble quaternary ammonium salt polymers described in U.S. Pat. No. 3,709,690; and water-insoluble quaternary ammonium salt polymers described in U.S. Pat. No. 3,898,088.

Further, in order to prevent the dyes from moving from a specific layer to other layers or into a processing solution to avoid a photographically disadvantageous influence, it is particularly preferable for the anion-modified polymer to be used as an aqueous polymer latex which is prepared by copolymerizing monomers having at least two or more, preferably 2 to 4, ethylenically unsaturated groups and then cross-linking the polymer.

In the present invention, the methods for coating the emulsion layers and surface protective layer on the support are not specifically limited. For example, the multilayer simultaneous coating method described in U.S. Pat. Nos. 2,761,418, 3,508,947, and 2,761,791 can be advantageously used.

The developing solutions used in the present invention can contain conventional developing agents. Examples thereof are dihydroxybenzenes (e.g., hydroquinone), 3-pyrazolidones (e.g., 1-phenyl-3-pyrazolidone), and aminophenols (e.g., N-methyl-p-aminophenol). They can be used alone or as a combination thereof. In addition, the developing solutions usually contain a preservative, an alkali agent, a pH buffer agent and an antifoggant, each of which is well known, and if desired, may further contain a dissolution aid, a color toning agent, a development accelerator (e.g., a quaternary salt, hydrazine and benzyl alcohol), a surfactant, a deforming agent, a hard water softener, a hardener (e.g., glutaric aldehyde), and a tackifier.

Fixing solutions with conventional compositions can be used. Organic sulfur compounds having a known effect as a fixing agent as well as thiosulfates and thiocyanates can be used as a fixing agent. The fixing agents may contain a water-soluble aluminium salt as the hardener, if desired.

In the present invention, development processing with an automatic processor is carried out, preferably using a roller transport type automatic processor described in U.S. Pat. Nos. 3,025,779, 3,515,556, 3,573,914, and 3,647,459, and British Patent 1,269,268.

The developing temperature is preferably 18° to 50° C., particularly 30° to 45° C. The developing time is preferably 6 to 25 seconds.

The total processing time in all of the processing steps of developing, fixing, washing and drying is preferably 20 to 100 seconds, and more preferably 20 to 60 seconds.

A polyethylene terephthalate film or a cellulose triacetate film is preferred as a support.

The support is subjected preferably to a corona discharge treatment, a glow discharge treatment or an ultraviolet irradiation treatment in order to improve the adhesiveness thereof to a hydrophilic colloid layer. Further, the support may be provided with a subbing layer comprising a styrene-butadiene latex and a vinylidene chloride latex, and a gelatin layer may be provided thereon.

A subbing layer comprising a polyethylene swelling agent and gelatin can be used by applying the solution prepared by dissolving them in an organic solvent. These subbing layers can be combined with a surface treatment to further improve adhesiveness to a hydrophilic colloid layer.

A plasticizer such as a polymer and an emulsion can be incorporated into an emulsion layer of the photographic material of the present invention in order to improve the pressure property.

For example, the methods in which a heterocyclic compound is used in British Patent 738,618; alkyl phthalate in British Patent 738,637; alkyl ester in British Patent 738,639; polyhydric alcohol in U.S. Pat. No. 2,960,404; carboxyalkylcellulose in U.S. Pat. No. 3,121,060; paraffin and carboxylic acid salt in JP-A-49-5017; and alkyl acrylate and organic acid in JP-A-53-28086 can be used.

The other components of the emulsion layer of the silver halide photographic material of the present invention are not specifically limited and various additives can be used as needed. For example, a binder, a surfactant, other dyes, a coating aid and a tackifier described in *Research disclosure*, Vol. 176, pp. 22 to 28, (December, 1978) can be used.

Further, the various additives and development processing methods which can be used in the present invention are described in the following portions of JP-A-2-68539:

| Item | Corresponding portions |
|---|---|
| 1. Silver halide Emulsion and Production Methods thereof | 6th line from bottom, right lower column on p. 8 to 12th line, right upper column on p. 10 |
| 2. Chemical Sensitizing Methods | 13th line, right upper column to 16th line, left lower column on p. 10 |
| 3. Antifoggants and Stabilizers | 17th line, left lower column on p. 10 to 7th line, left upper column on p. 11, and 2nd line, left lower column on p. 3 to left lower column on p. 4 |
| 4. Spectral Sensitizing Dyes | 4th line, right lower column on p. 4 to right lower column on p. 8 |
| 5. Surfactants and Anti-Static Agents | 14th line, left upper column on p. 11 to 9th line, left upper column on p. 12 |

-continued

| Item | Corresponding portions |
|---|---|
| 6. Matting Agents, Lubricants and Plasticizers | 10th line, left upper column to 10th line, right upper column on p. 12; 10th line, left lower column to 1st line, right lower column on p. 14 |
| 7. Hydrophilic Colloids | 11th line, right upper column to 16th line, left lower column on p. 12 |
| 8. Hardeners | 17th line, left lower column on p. 12 to 6th line, right upper column on p. 13 |
| 9. Supports | 7th to 20 lines, right upper column on p. 13 |
| 10. Dyes and Mordants | 1st line, left lower column on p. 13 to 9th line, left lower column on p. 14 |
| 11. Development Processing Methods | JP-A-2-103037: 7th line, right upper column on p. 16 to 15th line, left lower column on p. 19. JP-A-2-115837: 5th line, right lower column on p. 3 to 10th line, right upper column on p. 6 |

The following examples are given to further illustrate the present invention but the present invention is not to be construed as being limited to these examples. Unless otherwise indicated herein, all parts, percents, ratios and the like are by weight.

EXAMPLE 1

Preparation of the Emulsion I-a

To a solution containing 7 g of potassium bromide, 30 g of gelatin, 2.5 ml of a 5% aqueous solution of thioether $HO(CH_2)_2S(CH_2)_2S(CH_2)_2OH$ in one liter of water were added an aqueous solution containing 8.33 g of silver nitrate and an aqueous solution containing 6.5 g of potassium bromide by the double-jet method over a 45 second period while stirring and maintaining the temperature of the solution at 60° C. Subsequently, after adding 2.5 g of potassium bromide, an aqueous solution containing 8.33 g of silver nitrate was added over a 26 minute period at such a rate that a flow amount at the completion of addition was twice that at the initiation of addition. After 13 ml of a 25% ammonia solution and 10 ml of a 50% $NH_4NO_3$ solution were added to carry out a physical ripening for 20 minutes, 160 ml of 1N sulfuric acid were added to neutralize, followed by adding an aqueous solution containing 153.34 g of silver nitrate and a mixed aqueous solution of potassium bromide and potassium iodide using the controlled double-jet method over a 40 minute period while maintaining the pAg at 8.2, wherein the amount of potassium iodide added, which was calculated from the total addition amount of a mixed aqueous solution of potassium bromide and potassium iodide, was 1.328 g; and the flow rate was accelerated so that the flow amount at the completion of the addition became nine times that at the initiation of addition. After the completion of this addition, 5 ml of a 2N potassium thiocyanate solution was added. Then, the temperature was lowered to 35° C. and the water-soluble salts were removed by a precipitation method. Then, the temperature was increased to 40° C. and 30 g of gelatin and 2 g of phenol were added, followed by adding sodium hydroxide and potassium bromide to adjust the pH and pAg to 6.4 and 8.10, respectively.

The temperature was increased to 56° C. and 600 mg of Sensitizing Dye (S-1) and 100 mg of Stabilizer (F-1), each having the following chemical structure, were added. After 10 minutes, 2.4 mg of sodium thiosulfate pentahydrate, 100 mg of potassium thiocyanate and 2.1 mg of chloroauric acid were added to the emulsion. The emulsion was rapidly cooled down 80 minutes later and solidified to obtain the emulsion. The emulsion thus obtained comprised grains having an aspect ratio of 3 or more, which correspond to 95% of the sum of the projected area of the total grains. Grains having an aspect ratio of 2 or more have an average projected area-corresponding circle diameter of 1.4 μm, a standard deviation of 13%, an average thickness of 0.2 μm and an average aspect ratio of 7.0. This emulsion had a silver iodide content of 0.8 mol %.

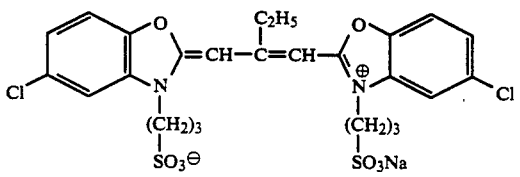

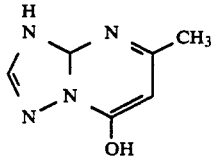

Preparation of the Emulsion 1-b

Emulsion 1-b was prepared in the same manner as Emulsion 1-a above except that the mixed ratio of potassium bromide and potassium iodide contained in the mixed aqueous solution added by the double-jet method was different. The addition amount of potassium iodide, which was calculated from the total addition amount of the mixed aqueous solution, was 0.664 g.

The emulsion thus obtained comprised the grains having an aspect ratio of 3 more, which correspond to 98% of the sum of the projected area of the total grains. Grains having an aspect ratio of 2 or more have an average projected area-corresponding circle diameter of 1.36 μm, a standard deviation of 15%, an average thickness of 0.202 μm and an average aspect ratio of 6.7. This emulsion had a silver iodide content of 0.4 mol %.

Preparation of the Emulsion 1-c

Emulsion 1-c was prepared in the same manner as Emulsion 1-a except that the mixed aqueous solution of potassium bromide and potassium iodide was replaced with a potassium bromide aqueous solution. The emulsion thus obtained comprised grains having an aspect ratio of 3 or more, which correspond to 95% of the sum of the projected area of the total grains. Grains having an aspect ratio of 2 or more have an average projected area-corresponding circle diameter of 1.4 μm, a standard deviation of 14%, an average thickness of 0.189 μm and an average aspect ratio of 7.4. This emulsion was a pure silver bromide emulsion.

Preparation of the Emulsion 1-d

To a solution containing 5 g of potassium bromide, 0.05 g of potassium iodide, 30 g of gelatin, 3.0 ml of a 5% aqueous solution of thioether $HO(CH_2)_2S(CH_2)_2S(CH_2)_2OH$ in one liter of water were added an aqueous solution containing 8.33 g of silver nitrate and an aqueous solution containing 5.94 g of potassium bromide and 1.00 g of potassium iodide using double-jet method over a 45 second period while stirring and maintaining the temperature of the solution at 73° C. Subsequently, after adding 2.5 g of potassium bromide, an aqueous solution containing 8.33 g of silver nitrate was added for 26 minutes at such a rate that the flow amount at the completion of addition became twice the rate at the initiation of addition. Then, 20 ml of a 25% ammonia solution and 10 ml of a 50% $NH_4NO_3$ solution were added to carry out physical ripening for 20 minutes and 240 ml of 1N sulfuric acid were added to neutralize the system, followed by adding an aqueous solution containing 153.34 g of silver nitrate and a mixed aqueous solution of potassium bromide and potassium iodide using the controlled double-jet method over a 40 minute period while maintaining the pAg at 8.2. The addition amount of potassium bromide, which was calculated from the total addition amount of the mixed aqueous solution of potassium bromide and potassium iodide, was 0.278 g; and the flow rate was accelerated so that the flow amount at the completion of addition was nine times as large as that at the initiation of addition. After the completion of addition, 15 ml of a 2N potassium thiocyanate solution was added. Then, the temperature was lowered to 35° C. and water-soluble salts were removed by a precipitation method. The temperature was raised to 40° C. and 30 g of gelatin and 2 g of phenol were added, followed by adding sodium hydroxide and potassium bromide to adjust the pH and pAg to 6.40 and 8.10, respectively.

The temperature was raised to 56° C. and 600 mg of Sensitizing Dye S-1 and 150 mg of the Stabilizer F-1 each having the chemical structure shown above were added. After 10 minutes, 2.4 mg of sodium thiosulfate pentahydrate, 140 mg of potassium thiocyanate and 2.1 mg of chloroauric acid were added to the emulsion, which was rapidly cooled 80 minutes later and solidified to obtain the emulsion. The emulsion thus obtained comprised grains having an aspect ratio of 3 or more, which correspond to 98% of the sum of the projected area of the total grains. Grains having an aspect ratio of 2 or more have an average projected area-corresponding circle diameter of 1.52 μm, a standard deviation of 15%, an average thickness of 0.194 μm and an average aspect ratio of 7.8. This emulsion had a silver iodide content of 0.8 mol %.

Preparation of Emulsion 1-e

Emulsion 1-e was prepared in the same manner as Emulsion 1-d except that the mixed ratio of potassium bromide and potassium iodide present in the mixed aqueous solution added by the double-jet method was different, with the amount of potassium iodide added, which was calculated from the total amount of the mixed aqueous solution added, was 0.61 g.

The emulsion thus obtained comprised grains having an aspect ratio of 3 or more, which correspond to 98% of the sum of the projected area of the total grains. Grains having an aspect ratio of 2 or more have an average projected area-corresponding circle diameter of 1.51 μm, a standard deviation of 17%, an average thickness of 0.201 μm and an average aspect ratio of 7.5. This emulsion had a silver iodide content of 1 mol %.

Preparation of Emulsion 1-f

To a solution containing 5 g of potassium bromide, 0.05 g of potassium iodide, 30 g of gelatin, 3.0 ml of a 5% aqueous solution of thioether $HO(CH_2)_2S(CH_2)_2S(CH_2)_2OH$ in one liter of water were added an aqueous solution containing 8.33 g of silver nitrate and an aqueous solution containing 5.94 g of potassium bromide and 1.00 g of potassium iodide by the double-jet method for 45 seconds while stirring and maintaining the temperature of the solution at 73° C. Subsequently, after adding 2.5 g of potassium bromide, an aqueous solution containing 8.33 g of silver nitrate was added over a 26 minute period at such a rate that the flow amount at the completion of addition was twice that at the initiation of addition. Then, 20 ml of a 25% ammonia solution and 10 ml of a 50% $NH_4NO_3$ solution were added for physical ripening for 20 minutes and 240 ml of 1N sulfuric acid were added to neutralize the system, followed by adding an aqueous solution containing 153.34 g of silver nitrate and a potassium bromide aqueous solution by the controlled double-jet method over a 40 minute period while maintaining a potential at pAg 8.2, wherein a flow rate was accelerated so that the flow amount at the completion of addition was nine times that at the initiation of addition. After the completion of addition, 15 ml of a 2N potassium thiocyanate solution was added and 28 ml of a 1% aqueous solution of potassium iodide was added for 30 seconds. Then, the temperature was lowered to 35° C. and water-soluble salts were removed by a precipitation method. The temperature was raised to 40° C. and 30 g of gelatin and 2 g of phenol were added, followed by adding sodium hydroxide and potassium bromide to adjust the pH and pAg to 6.40 and 8.10, respectively.

The temperature was raised to 56° C. and 600 mg of Sensitizing Dye S-1 and 150 mg of Stabilizer F-1, each having the chemical structure set forth above, were added. After 10 minutes, 2.4 mg of sodium thiosulfate pentahydrate, 140 mg of potassium thiocyanate and 2.1 mg of chloroauric acid were added to the emulsion, which was rapidly cooled 80 minutes later and solidified to obtain the emulsion. The emulsion thus obtained comprised grains having an aspect ratio of 3 or more, which correspond to 98% of the sum of the projected area of the total grains. Grains having an aspect ratio of 2 or more have an average projected area-corresponding circle diameter of 1.5 μm, a standard deviation of 18%, an average thickness of 0.192 μm and an average aspect ratio of 7.8. This emulsion had a silver iodide content of 0.8 mol %.

Preparation of Emulsion Coating Solutions Coating Solution 1-1

The following compounds, per mol of silver halide, were added to Emulsion 1-a to prepare Coating Solution 1-1:

| | |
|---|---|
| Gelatin amount added was adjusted so that the Ag/gelatin ratio became | 0.9 |
| Polymer Latex (copolymer of ethyl acrylate and methacrylic acid (97/3)) | 25.0 g |
| 1,2-bis(Sulfonylacetamide) Ethane (per 100 g of gelatin present in the surface protective layer and the emulsion layers) | 8 millimol |

-continued

| | |
|---|---|
| 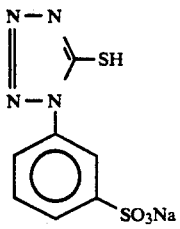 | 40 mg |
| 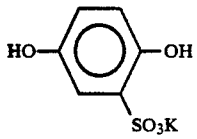 | 12 g |
| (per mol of AgI) | |
| 2,6-bis(Hydroxyamino)-4-diethylamino 1,3,5-triazine | 80 mg |
| Poly-sodium Polyacrylate (average molecular weight: 41,000)' | 2.0 g |
| Dextram (average molecular weight: 39,000) | 2.0 g |
| Poly-potassium Styrenesulfonate (average molecular weight: 600,000) | 1.0 g |

Coating solution 1-2

A coating solution having the same composition as that of Coating Solution 1-1 was prepared except that Emulsion 1-a was replaced with Emulsion 1-b.

Coating solution 1-3

A coating solution having the same composition as that of Coating Solution 1-1 was prepared except that Emulsion 1-a was replaced with Emulsion 1-c.

Coating solution 1-4

A coating solution having the same composition as that of Coating Solution 1-2 was prepared except that the ratio Ag/gelatin was 1.3.

Coating Solution 2-1

A coating solution having the same composition as that of Coating Solution 1-1 was prepared except that Emulsion 1-a was replaced with Emulsion 1-d.

Coating Solution 2-2

A coating solution having the same composition as that of Coating Solution 1-2 was prepared except that Example 1-b was replaced with Emulsion 1-e.

Coating Solution 2-3

A coating solution having the same composition as that of coating Solution 1-3 was prepared except that Emulsion 1-c was replaced with Emulsion 1-f.

Preparation of Support with a Mordant Layer

A composition containing the following compounds was coated on a blue-colored polyethylene terephthalate support with a thickness of 175 μm to prepare a support having a mordant layer.

| | |
|---|---|
| Gelatin | 84 mg/m² |

-continued

| | |
|---|---|
| 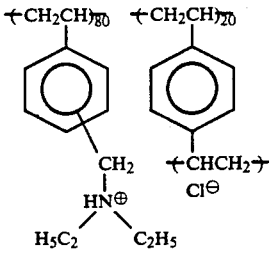 | 60 mg/m² |
| 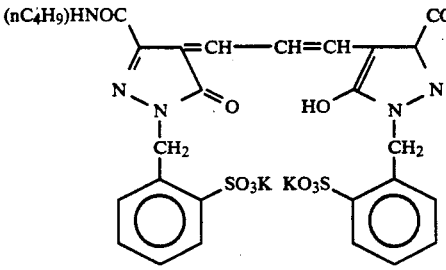 | 17 mg/m² |

The above emulsion coating solutions and the surface protective layer coating solution were applied simultaneously on both sides of the PET support with the mordant layer so that the coated silver amount per side was 1.8 g/m² to prepare light-sensitive material Samples No. 1 to 6. The structures of these samples are shown in Table 1 below.

TABLE 1

| Sample No. | Coating Solution 1 | 2 | 3 | 4 | 5 | 6 | Coated Ag Amount |
|---|---|---|---|---|---|---|---|
| Surface Protective Layer | | | | | | | |
| 2nd Em Layer | 2-1 | 2-1 | 2-1 | 2-2 | 2-3 | 2-1 | 0.9 g/m² |
| 1st Em layer | 1-1 | 1-2 | 1-3 | 1-3 | 1-2 | 1-4 | 0.9 g/m² |
| Support | | | | | | | |
| 1st Em Layer | 1-1 | 1-2 | 1-3 | 1-3 | 1-2 | 1-4 | 0.9 g/m² |
| 2nd Em Layer | 2-1 | 2-1 | 2-1 | 2-2 | 2-3 | 2-1 | 0.9 g/m² |
| Surface Protective Layer | | | | | | | |
| Composition of Surface Protective Layer | | | | | | | |
| Gelatin | | | | | | | 1.15 g/m² |
| Polyacrylamide (average molecular weight: 45,000) | | | | | | | 0.25 g/m² |
| Poly-sodium Acrylate (average molecular weight: 400,000) | | | | | | | 0.02 g/m² |
| Sodium p-t-Octylphenoxy Diglyceryl Butylsulfonate | | | | | | | 0.02 g/m² |
| Polyoxyethylene (polymerization degree: 10)-Polyoxyglyceryl (polymerization degree: 3)-p-Octyl-phenoxy Ether | | | | | | | 0.01 g/m² |
| $C_8F_{17}SO_3K$ | | | | | | | 0.003 g/m² |
| $C_8F_{17}SO_2N(C_3H_7)(CH_2CH_2O)_{10}CH_2CH(OH)CH_2O)_4H$ | | | | | | | 0.003 g/m² |
| 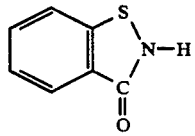 | | | | | | | 0.005 g/m² |
| $C_8F_{17}SO_2N(C_3H_7)(CH_2)_4(CH_2)_4SO_3Na$ | | | | | | | 0.001 g/m² |
| Polymethyl Methacrylate | | | | | | | 0.025 g/m² |

TABLE 1-continued

| | |
|---|---|
| (average grain size: 3.5 μm) | |
| Copolymer of Methyl Methacrylate and Methacrylic Acid (molar ratio: 7/3, average grain size: 2.5 μm) | 0.020 g/m² |

Evaluation of Roller Marks and Drying Properties

1) Results of 90 Second Processing

Each sample was exposed with a sensitometer and the exposed samples were processed with a Fuji X-ray automatic processor RN for 90 seconds, wherein the samples were developed at 38° C. for 20 seconds in a developing solution of the following composition:

| Composition of Developing Solution | |
|---|---|
| Potassium Hydroxide | 29 g |
| Glacial Acetic Acid | 11 g |
| Potassium Sulfite | 44 g |
| Sodium Bicarbonate | 7.5 g |
| Boric Acid | 1 g |
| Diethylene Glycol | 29 g |
| Ethylenediaminetetraacetic Acid | 1.7 g |
| 5-Methylbenzotriazole | 0.06 g |
| 5-Nitroindazole | 0.25 g |
| Hydroquinone | 30 g |
| 1-Phenyl-3-pyrazolidone | 1.5 g |
| Sodium Metabisulfite | 12.6 g |
| Glutaraldehyde | 1 g |
| Potassium Bromide | 6 g |
| Water was added to make the total quantity 1.0 liter (pH: 10.25) | |

After processing, each sample was visually observed to evaluate the presence of roller marks formed thereon. The level of roller marks was classified into five grades of A to E, in which A corresponded to no roller marks and E corresponded to many roller marks formed.

2) Results of 38 Second Processing

| Composition of the Developer Solution | |
|---|---|
| Potassium Hydroxide | 17 g |
| Sodium Sulfite | 29 g |
| Potassium Sulfite | 39 g |
| Triethylenetetraminehexacetic Acid | 2 g |
| Boric Acid | 3 g |
| Hydroquinone | 28 g |
| 1-Phenyl-3-pyrazolidone | 1.7 g |
| 5-Nitroindazole | 0.2 g |
| 5-Methylbenzotriazole | 0.02 g |
| Glutaraldehyde | 5 g |
| Potassium Bromide | 2 g |
| Water was added to make the total quantity 1 liter (pH was adjusted to 10.25) | |
| **Composition of Fixing Solution** | |
| Ammonium Thiosulfate (70% wt/vol) | 250 ml |
| Sodium Sulfite | 15 g |
| Boric Acid | 8 g |
| Disodium Ethylenediaminetetracetate dihydrate | 0.025 g |
| Sodium Hydroxide | 6 g |
| Aluminium Sulfate | 15 g |
| Water was added to make the total quantity 1 liter (pH was adjusted to 4.65 with acetic acid) | |

The above described developing solution and fixing solution were put in the developing tank and fixing tank, respectively, of the automatic processor and development processing was carried out under the following conditions:

Automatic Processor:

a FPM-9000 manufactured by Fuji Photo Film Co., Ltd., modified in the operation system as follows

| Processing | Tank Capacity | Temperature | Processing Time |
|---|---|---|---|
| Developing | 22 liters | 35° C. | 11.1 seconds |
| Fixing | 15.5 liters | 35° C. | 8.6 seconds |
| Washing | 14 liters | 20° C. | 5.1 seconds |
| Drying | 55° C. | | |
| Total processing time on a dry to dry basis: | | | 38 seconds |

The results of the 90 second processing and the 38 second processing are shown below in Tables 2 and 3, respectively.

TABLE 2

| Sample No. | Roller Marks | Drying Property |
|---|---|---|
| 1 (Comp.) | E | Good |
| 2 (Inv.) | B | Good |
| 3 (Inv.) | A | Good |
| 4 (Inv.) | B | Good |
| 5 (Inv.) | C | Good |
| 6 (Inv.) | C | Good |

TABLE 3

| Sample No. | Roller Marks | Drying Property |
|---|---|---|
| 1 (Comp.) | C–D | Wet |
| 2 (Inv.) | A | Wet |
| 3 (Inv.) | A | Wet |
| 4 (Inv.) | A | Wet |
| 5 (Inv.) | B | Wet |
| 6 (Inv.) | B | Good |

In the results shown in Table 2, the AgI content of the first layer of light-sensitive material Sample No. 1 is 0.8 mol/mol of Ag, which is the same as that of the second layer, and the layer of roller marks is not practical for use. Light-sensitive material Sample No. 2 of the present invention has a level of roller marks which markedly improved because of the reduction in the AgI content of the emulsion of the first layer. Further, the effects of the present invention are confirmed in light-sensitive material Sample Nos. 3 and 4, in which the emulsion of the first layer contained pure silver bromide. While the emulsion of the second layer in light-sensitive material Sample No. 5 has the same AgI content as that of the second layer in light-sensitive material Sample No. 2 because it was prepared by adding the KI solution at the final stage of the grain formation, it has a roller marks level which is one level lower than that of light-sensitive material Sample No. 2. It is assumed that this is due to the partial control of the level of the roller marks by the AgI content on the surface of the grains but the details are not clear at present.

It can be seen from the results of the 38 second processing shown in Table 3 that light-sensitive material Sample No. 6 of the present invention in which the Ag/binder ratio was increased is suitable for superrapid processing and that it has an allowable level of the roller marks in either of the 90 second and the 38 second processings.

EXAMPLE 2

Preparation of Emulsion 2-a

To a solution containing 5 g of potassium bromide, 0.05 g of potassium iodide, 30 g of gelatin, 2.5 ml of a 5% aqueous solution of thioether $HO(CH_2)_2S(CH_2)_2S(CH_2)_2OH$ in one liter of water were added an aqueous solution containing 8.33 g of silver nitrate and an aqueous solution containing 5.94 g of potassium bromide and 0.726 g of potassium iodide by the double-jet method over a 45 second period while stirring and maintaining the temperature of the solution at 73° C. Subsequently, after adding 2.5 g of potassium bromide, an aqueous solution containing 8.33 g of silver nitrate was added over a 26 minute period in such a rate that the flow amount at the completion of addition was twice that at the initiation of addition. Then, 20 ml of a 25% ammonia solution and 10 ml of a 50% $NH_4NO_3$ solution were added to carry out physical ripening for 20 minutes and 240 ml of 1N sulfuric acid were added to neutralize the solution, followed by adding an aqueous solution containing 153.34 g of silver nitrate and a potassium bromide aqueous solution by the controlled double-jet method over a 40 minute period while maintaining the potential at pAg 8.2, wherein a flow rate was accelerated so that the flow amount at the completion of addition was nine times that at the initiation of addition. After the completion of addition, 15 ml of a 2N potassium thiocyanate solution was added and further, 55 ml of a 1% aqueous solution of potassium iodide was added over a 30 second period. Then, the temperature was lowered to 35° C. and water-soluble salts were removed by a precipitation method. The temperature was raised to 40° C. and 30 g of gelatin and 2 g of phenol were added, followed by adding sodium hydroxide and potassium bromide to adjust the pH and Ag to 6.40 and 8.10, respectively.

The temperature was raised to 56° C. and 600 mg of a sensitizing dye and 150 mg of a stabilizer, each having the following chemical structure, were added. After 10 minutes, 2.4 mg of sodium thiosulfate pentahydrate, 140 mg of potassium thiocyanate and 2.1 mg of chloroauric acid were added to the emulsion, which was rapidly cooled 80 minutes later and solidified to obtain the emulsion. The emulsion thus obtained comprised grains having an aspect ratio of 3 or more, which correspond to 98% of the sum of the projected area of the total grains. Grains having an aspect ratio of 2 or more have an average projected area-corresponding circle diameter of 1.4 μm, a standard deviation of 15%, an average thickness of 0.187 μm and an average aspect ratio of 7.5. This emulsion had a silver iodide content of 0.8 mol %.

Sensitizing Dye

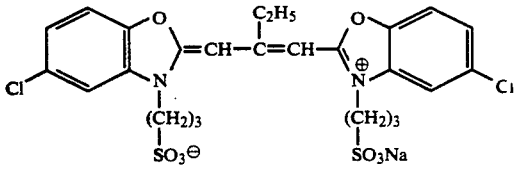

Stabilizer

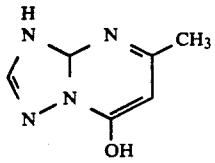

Preparation of Emulsion 2-b

To a solution containing 7 g of potassium bromide, 30 g of gelatin, 2.5 ml of a 5% aqueous solution of thioether $HO(CH_2)_2S(CH_2)_2S(CH_2)_2OH$ in one liter of water were added an aqueous solution containing 8.33 g of silver nitrate and an aqueous solution containing 6.5 g of potassium bromide by the double-jet method over a 45 second period while stirring and maintaining the temperature of the solution at 60° C. Subsequently, after adding 2.5 g of potassium bromide, an aqueous solution containing 8.33 g of silver nitrate was added over a 26 minute period at such a rate that the flow amount at the completion of addition was twice that at the initiation of addition. After 13 ml of a 25% ammonium solution and 10 ml of a 50% $NH_4NO_3$ solution were added to carry out physical ripening for 20 minutes, 160 ml of 1N sulfuric acid was added to neutralize the solution, followed by adding an aqueous solution containing 153.34 g of silver nitrate and an aqueous solution of potassium bromide by the controlled double-jet method over a 40 minute period while maintaining the potential at pAg 8.2, wherein the flow rate was accelerated so that the flow amount at the completion of addition was nine times that at the initiation of addition. After the completion of the addition, 5 ml of 2N potassium thiocyanate solution was added. Then, the temperature was lowered to 35° C. and the water-soluble salts were removed by a precipitation method. Then, the temperature was raised to 40° C. and 30 g of gelatin and 2 g of phenol were added, followed by adding sodium hydroxide and potassium bromide to adjust the pH and pAg to 6.40 and 8.10, respectively.

The temperature was raised to 56° C. and 600 mg of a sensitizing dye and 100 mg of a stabilizer, each having the following chemical structure, were added. After 10 minutes, 2.4 mg of sodium thiosulfate pentahydrate, 100 mg of potassium thiocyanate and 2.1 mg of chloroauric acid were added to the emulsion, which was rapidly cooled 80 minutes later and solidified to obtain the emulsion. The emulsion thus obtained comprised grains having an aspect ratio of 3 or more, which correspond to 95% of the sum of the projected area of the total grains. Grains having an aspect ratio of 2 or more have an average projected area-corresponding circle diameter of 1.4 μm, a standard deviation of 13%, an average thickness of 0.2 μm and an average aspect ratio of 7.0. This emulsion was a pure silver bromide emulsion.

Sensitizing Dye

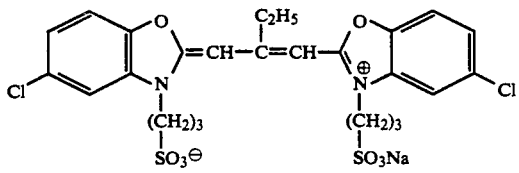

Stabilizer

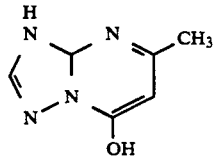

Preparation of Emulsion 2-c

To a solution containing 5 g of potassium bromide, 0.05 g of potassium iodide, 30 g of gelatin, 3.0 ml of a 5% aqueous solution of thioether $HO(CH_2)_2S(CH_2)_2S(CH_2)_2OH$ in one liter of water were added an aqueous solution containing 8.33 g of silver nitrate and an aqueous solution containing 5.94 g of potassium bromide and 1.00 g of potassium iodide by the double-jet method over a 45 second period while stirring and maintaining the temperature of the solution at 73° C. Subsequently, after adding 2.5 g of potassium bromide, an aqueous solution containing 8.33 g of silver nitrate was added for 26 minutes at such a rate that the flow amount at the completion of addition was twice that at the initiation of addition. Then, 20 ml of a 25% ammonium solution and 10 ml of a 50% $NH_4NO_3$ solution were added to carry out physical ripening for 20 minutes and 240 ml of 1N sulfuric acid was added to neutralize the solution, followed by adding an aqueous solution containing 153.34 g of silver nitrate and a potassium bromide aqueous solution by the controlled double-jet method over a 40 minute period while maintaining the potential at pAg 8.2, wherein the flow rate was accelerated so that a flow amount at the completion of addition was nine times that at the initiation of addition. After the completion of addition, 15 ml of a 2N potassium thiocyanate solution was added and further, 55 ml of a 1% aqueous solution of potassium iodide was added over a 30 second period. Then, the temperature was lowered to 35° C. and water-soluble salts were removed by a precipitation method. The temperature was raised to 40° C. and 30 g of gelatin and 2 g of phenol were added, followed by adding sodium hydroxide and potassium bromide to adjust the pH and pAg to 6.40 and 8.10, respectively.

The temperature was raised to 56° C. and 600 mg of a sensitizing dye and 150 mg of a stabilizer, each having the following chemical structure, were added. After 10 minutes, 2.4 mg of sodium thiosulfate pentahydrate, 140 mg of potassium thiocyanate and 2.1 mg of chloroauric acid were added to the emulsion, which was rapidly cooled 80 minutes later and solidified to obtain the emulsion. The emulsion thus obtained comprised grains having an aspect ratio of 3 or more, which correspond to 98% of the sum of a projected area of the total grains. Grains having an aspect ratio of 2 or more have an average projected area-corresponding circle diameter of 1.5 μm, a standard deviation of 18%, an average thickness of 0.192 μm and an average aspect ratio of 7.8. This emulsion had a silver iodide content of 0.96 mol %.

Sensitizing Dye

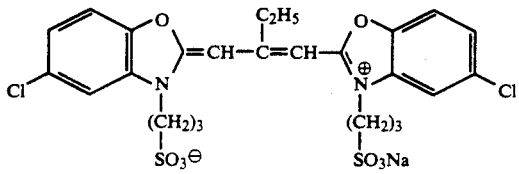

Stabilizer

-continued

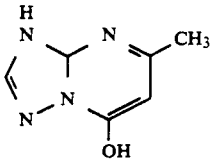

Preparation of Emulsion Coating Solutions

Coating Solution 1-1

The following compounds, per mol of silver halide were added to the Emulsion 2-a to prepare Coating Solution 1-1:

| | |
|---|---|
| Gelatin amount added was adjusted so that the Ag/gelatin ratio became | 1.5 |
| Polymer Latex (copolymer of ethyl acrylate and methacrylic acid (97/3)) | 25.0 g |
| 1,2-bis(Sulfonylacetamide) Ethane (per 100 g of gelatin present in surface protective layer and emulsion layers) | 8 millimol |
| 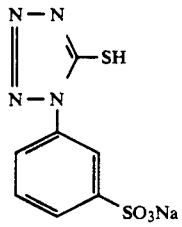 | 40 mg |
| 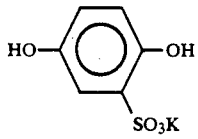 (per mol of AgI) | 12 g |
| 2,6-bis(Hydroxyamino)-4-diethylamino-1,3,5-triazine | 80 mg |
| Poly-sodium Polyacrylate (average molecular weight: 41,000) | 2.0 g |
| Dextran (average molecular weight: 39,000) | 2.0 g |
| Poly-potassium Styrenesulfonate (average molecular weight: 600,000) | 1.0 g |

Coating Solution 1-2

A coating solution having the same composition as that of Coating Solution 1-1 was prepared except that the Ag/gelatin ratio was 0.7.

Coating Solution 1-3

A coating solution having the same composition as that of Coating Solution 1-1 was prepared except that Emulsion 2-a was replaced with Emulsion 2-b.

Coating Solution 1-4

A coating solution having the same composition as that of Coating Solution 1-2 was prepared except that Emulsion 2-a was replaced with Emulsion 2-b.

Coating Solution 2-1

A coating solution having the same composition as that of Coating Solution 1-1 was prepared except that Emulsion 2-a was replaced with Emulsion 2-c.

Coating Solution 2-2

A coating solution having the same composition as that of Coating Solution 1-2 was prepared except that Emulsion 2-a was replaced with Emulsion 2-c.

Preparation of Support having a Mordant Layer

A composition comprising the following compounds was coated on a blue-colored polyethylene terephthalate support having a thickness of 175 μm to prepare a support having a mordant layer.

Gelatin 84 mg/m²

60 mg/m²

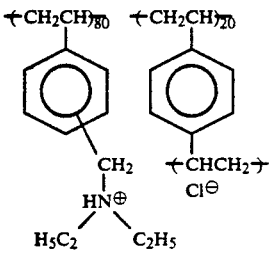

17 mg/m²

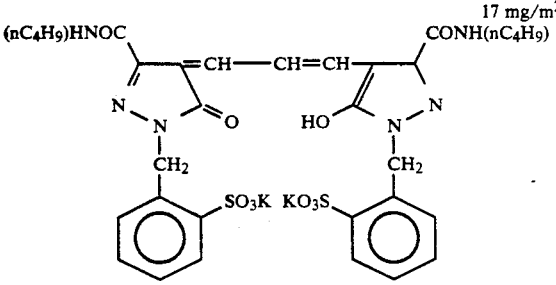

Preparation of Light-Sensitive Material Sample Nos. 7 to 10

The above emulsion coating solutions and the surface protective layer coating solution were applied simultaneously on both sides of the PET support having the mordant layer so that the coated silver amount per side was 1.8 g/m², whereby light-sensitive material Sample Nos. 7 to 10 were prepared. The structures thereof are shown below:

TABLE 1

| Sample No. | Coating Solution 7 | 8 | 9 | 10 | Coated Ag Amount |
|---|---|---|---|---|---|
| Surface Protective Layer | | | | | |
| 2nd EM Layer | 2-1 | 2-2 | 2-1 | 2-2 | 0.9 g/m² |
| 1st EM Layer | 1-1 | 1-2 | 1-3 | 1-4 | 0.9 g/m² |
| Support | | | | | |
| 1st EM Layer | 1-1 | 1-2 | 1-3 | 1-4 | 0.9 g/m² |
| 2nd EM Layer | 2-1 | 2-2 | 2-1 | 2-2 | 0.9 g/m² |
| Surface Protective Layer | | | | | |
| Composition of Surface Protective Layer | | | | | |
| Gelatin | | | | | 1.15 g/m² |
| Polyacrylamide (average molecular weight: 45,000) | | | | | 0.25 g/m² |
| Poly-sodium Acrylate (average molecular weight: 400,000) | | | | | 0.02 g/m² |

TABLE 1-continued

| | |
|---|---|
| Sodium p-t-Octylphenoxy Diglyceryl Butylsulfonate | 0.02 g/m² |
| Polyoxyethylene (polymerization degree: 10)-Polyoxyglyceryl (polymerization degree: 3)-p-Octylphenoxy Ether | 0.01 g/m² |
| $C_8F_{17}SO_3K$ | 0.003 g/m² |
| $C_8F_{17}SO_2N(C_3H_7)(CH_2)_4(CH_2)_4SO_3Na$ | 0.001 g/m² |
| $C_8F_{17}SO_2N(C_3H_7)(CH_2CH_2O)_{10}(CH_2CH(OH)CH_2O)_4H$ | 0.003 g/m² |
| Polymethyl Methacrylate (average grain size: 3.5 μm) | 0.025 g/m² |
| Copolymer of Methyl Methacrylate and Methacrylic acid (molar ratio: 7/3, average grain size: 2.5 μm) | 0.020 g/m² |
| 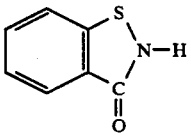 | 0.005 g/m² |

Evaluation of Roller Marks and Drying Properties

1) Results of 90 Second Processing

Each of the samples were exposed with a sensitometer and the exposed samples were processed with a Fuji X-ray automatic processor RN in 90 seconds, wherein the samples were developed at 38° C. for 20 seconds in a developing solution of the following composition:

| Composition of Developing Solution | |
|---|---|
| Potassium Hydroxide | 29 g |
| Glacial Acetic Acid | 11 g |
| Potassium Sulfite | 44 g |
| Sodium Bicarbonate | 7.5 g |
| Boric Acid | 1 g |
| Diethylene Glycol | 29 g |
| Ethylenediaminetetracetic Acid | 1.7 g |
| 5-Methylbenzotriazole | 0.06 g |
| 5-Nitroindazole | 0.25 g |
| Hydroquinone | 30 g |
| 1-Phenyl-3-pyrazolidone | 1.5 g |
| Sodium Metabisulfite | 12.6 g |
| Glutaraldehyde | 1 g |
| Potassium Bromide | 6 g |
| Water was added to make the total quantity 1.0 liter (pH: 10.25) | |

After processing, each of the samples was visually observed to evaluate the roller marks formed thereon. The level of the roller marks was classified into the five grades of A to E, in which A corresponds to no roller marks and E corresponds to many roller marks formed. The results are shown in Table 4 below.

TABLE 4

| Sample No. | Roller Marks | Drying Property |
|---|---|---|
| 7 (Comp.) | E | Good |
| 8 (Comp.) | C-D | Good |
| 9 (Inv.) | B-C | Good |
| 10 (Inv.) | A-B | Good |

2) Results of 38 Second Processing

| Composition of Developing Solution | |
|---|---|
| Potassium Hydroxide | 17 g |
| Sodium Sulfite | 29 g |
| Potassium Sulfite | 39 g |
| Triethylenetetraminehexacetic Acid | 2 g |
| Boric Acid | 3 g |
| Hydroquinone | 28 g |
| 1-Phenyl-3-pyrazolidone | 1.7 g |
| 5-Nitroindazole | 0.2 g |
| 5-methylbenzotriazole | 0.02 g |
| Glutaraldehyde | 5 g |
| Potassium Bromide | 2 g |
| Water was added to make the total quantity 1 liter (pH was adjusted to 10.25) | |
| **Composition of Fixing Solution** | |
| Ammonium Thiosulfate (70% wt/vol) | 250 ml |
| Sodium Sulfite | 15 g |
| Boric Acid | 8 g |
| Disodium ethylenediaminetetracetate Dihydrate | 0.025 g |
| Sodium Hydroxide | 6 g |
| Aluminium Sulfate | 15 g |
| Water was added to make the total quantity 1 liter (pH was adjusted to 4.65 with acetic acid) | |

The above developing solution and fixing solution were put in the developing tank and fixing tank, respectively, of the automatic processor and the development processing was carried out under the following conditions:

Automatic processor:

FPM-9000 manufactured by Fuji Photo Film Co., Ltd. and modified in the operation system as follows.

| Processing | Tank Capacity | Temperature | Processing Time |
|---|---|---|---|
| Developing | 22 liters | 35° C. | 11.1 seconds |
| Fixing | 15.5 liters | 35° C. | 8.6 seconds |
| Washing | 14 liters | 20° C. | 5.1 seconds |
| Drying | | 55° C. | |

Total processing time on a dry to dry basis: 38 seconds

The results of the 38 second processing are shown in Table 5 below.

TABLE 5

| Sample No. | Roller Marks | Drying Property |
|---|---|---|
| 7 (Comp.) | C-D | Good |
| 8 (Comp.) | C | Wet |
| 9 (Inv.) | A-B | Good |
| 10 (Inv.) | A | Wet |

No differences in Dmin between light-sensitive material Sample Nos. 1 to 4 were observed.

It can be seen from the results of the 90 second and 38 second processings that the light-sensitive materials of the present invention has less roller marks and are suitable for rapid processing.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having, on at least one side thereof, two or more light-sensitive silver halide emulsion layers, each of said light-sensitive silver halide emulsion layers comprising a binder and a silver halide emulsion having a silver iodide content of 1 mol % or less, wherein the silver iodide content of the emulsion layer closest to the support is less than the silver iodide content of any of the emulsion layers further from the support than the emulsion layer closest to the support.

2. The photographic material as in claim 1, wherein the emulsion layer closest to the support comprises pure silver bromide and the emulsion layer(s) further from the support comprise(s) silver iodobromide.

3. The photographic material as in claim 1, wherein the weight ratio of silver/binder of the emulsion layer closest to the support is larger than the weight ratios of silver/binder of the other emulsion layers.

4. The photographic material as in claim 1, wherein the emulsion layers have a weight ratio of silver/binder of from 0.6 to 2.5.

5. The photographic material as in claim 1, wherein the emulsion layer closest to the support has a weight ratio of silver/binder of from 0.8 to 2.5.

6. The photographic material as in claim 1, wherein the silver halide emulsion of said two or more light-sensitive silver halide emulsion layers comprises tabular grains having an aspect ratio of 2 or more in a ratio of 70% or more of the projected area of the whole grains.

7. The photographic material as in claim 6, wherein the tabular grains have a projected area-corresponding diameter of from 0.3 to 2.0 μm and a thickness of from 0.05 to 0.3 μm.

8. The photographic material as in claim 6, wherein the average aspect ratio of the tabular grains is from 4 to 8.

9. A method of processing an imagewise exposed photographic material comprising subjecting the photographic material of claim 1 to processing with a roller-transporting type automatic processor including development, fixing and washing within a processing time of 20 to 100 seconds.

10. The method of processing a photographic material as in claim 9, wherein the processing time is from 20 to 60 seconds.

11. The photographic material as in claim 1, wherein the emulsion layer closest to the support has a silver iodide content of 0 to 0.1 mol %.

12. The photographic material as in claim 1, wherein each of the light-sensitive silver halide emulsion layers further from the support than the emulsion layer closest to the support has a silver iodide content of 0.1 to 1 mol %.

13. The photographic material as in claim 1, wherein each of the light-sensitive silver halide emulsion layers further from the support than the emulsion layer closest to the support has a silver iodide content of 0.2 to 0.8 mol %.

14. A silver halide X-ray photographic material comprising a support having on both sides thereof two or more light-sensitive silver halide emulsion layers, each of said light-sensitive silver halide emulsion layers on both sides of the support comprising a binder and a silver halide emulsion having a silver iodide content of 1 mol % or less, wherein the silver iodide content of the emulsion layer on each side of said support closest to the support is less than the silver iodide content of any of the emulsion layers on that side of the support further from the support than the emulsion layer closest to the support.

* * * * *